US005706556A

United States Patent [19]

Klüting

[11] Patent Number: 5,706,556

[45] Date of Patent: Jan. 13, 1998

[54] PINLESS SHEET-METAL HINGE WITH MAINTENANCE FREE BEARING FOR MOTOR VEHICLE DOORS

[75] Inventor: Bernd Alfred Klüting, Radevormwald, Germany

[73] Assignee: Ed. Scharwachter GmbH & Co., KG., Kemscheid, Germany

[21] Appl. No.: 477,814

[22] Filed: Jun. 7, 1995

[30] Foreign Application Priority Data

Jun. 8, 1994 [DE] Germany ..... 94 09 285 U

[51] Int. Cl.[6] ..... E05D 7/10

[52] U.S. Cl. ..... 16/273; 16/270; 16/265; 16/260

[58] Field of Search ..... 16/386, 260, 261, 16/264, 265, 270, 273, 380, 381

[56] References Cited

U.S. PATENT DOCUMENTS

| | | | |
|---|---|---|---|
| 32,482 | 6/1861 | Lane | 16/265 |
| 4,827,568 | 5/1989 | Ramsauer | 16/260 |
| 4,854,009 | 8/1989 | Brockhaus . | |
| 4,858,274 | 8/1989 | Harrison et al. | 16/270 |
| 5,092,017 | 3/1992 | Hatana et al. . | |

FOREIGN PATENT DOCUMENTS

| | | | |
|---|---|---|---|
| 1369502 | 7/1964 | France | 16/265 |

*Primary Examiner*—Daniel W. Howell
*Assistant Examiner*—Mark Williams
*Attorney, Agent, or Firm*—Cushman, Darby & Cushman IP Group of Pillsbury Madison & Sutro LLP

[57] ABSTRACT

The invention is based on a pinless sheet-metal hinge with maintenance-free bearing for motor vehicle doors, comprising two hinge halves, each securable via hinge tabs to one of the two parts of the door arrangement and meshing with one another with their single-joint regions, at least one of which is shaped from a sheet-metal material blank and in its single-joint region has two regions parallel to one another and oriented perpendicular to the hinge axis; the two hinge halves are supported pivotably on one another about a hinge axis with the interposition of bearing bushes made of a maintenance-free bearing material. In order to facilitate production using fully automatic machines, the invention proposes the provision of leadthroughs, concentric to one another and to the hinge axis, on the single-joint regions parallel to one another of each of the two hinge halves; the leadthroughs from one hinge half to the other have different diameters, such that the leadthroughs of the two hinge halves can be inserted in the manner of a male and female plug part.

16 Claims, 4 Drawing Sheets

PINLESS SHEET-METAL HINGE WITH MAINTENANCE FREE BEARING FOR MOTOR VEHICLE DOORS

FIELD OF THE INVENTION

The invention relates to a pinless sheet-metal hinge with a maintenance-free bearing for motor vehicle doors, comprising two hinge halves, each securable via hinge tabs to one of the two parts of the door arrangement and meshing with one another with their single-joint regions, at least one of which is shaped from a sheet-metal material blank and in its single-joint region has two regions parallel to one another and oriented perpendicular to the hinge axis, and where the two hinge halves are supported pivotably on one another about a hinge axis with the interposition of bearing bushes made of a maintenance-free bearing material.

BACKGROUND OF THE INVENTION

In the known, conventional models of motor vehicle door hinges in U.S. Pat. No. 5,092,017, both hinge halves of which are each formed from a sheet-metal material blank and are supported on one another by means of maintenance-free bearing means, the two hinge halves are joined pivotably to one another by a continuous hinge pin, which is supported in eyelet bores of the single-joint regions of each of the two hinge leaves. This kind of conventional embodiment of motor vehicle door hinge requires relatively great effort and expense for its production and assembly.

For vehicle doors, a type of motor vehicle door hinge has also already been disclosed by European Patent Application 0 215 568, in which the two hinge halves are likewise shaped from sheet-metal material blanks, but are not joined together by means of a continuous hinge pin. In this known sheet-metal hinge, a hinge pin stump is secured to each of the two single-joint regions of a hinge half and engages an eyelet bore, lines with a collar bush of a maintenance-free bearing material, in the corresponding single-joint region of the other hinge half. Since in this model two hinge pin stumps are needed that must be separately manufactured and secured to the single-joint regions of the hinge halves, the production cost for a hinge designed in this way is at least no less than that for a hinge provided with a continuous hinge pin.

OBJECT AND SUMMARY OF THE INVENTION

The object of the invention is to create a motor vehicle door hinge with a maintenance-free bearing, which is embodied of sheet-metal blanks and comprises the smallest possible number of individual parts, and that can be manufactured and assembled using fully automated machines.

According to the invention, this object is attained in by single-joint regions parallel to one another and in each of the two hinge halves, there are leadthroughs concentric to one another and to the hinge axis, and that the leadthroughs from one hinge half to the other have different diameters, such that the leadthroughs of the two hinge halves can be inserted in the manner of a male and female plug part. The leadthroughs form a kind of axle stump on one side and a kind of hub part on the other, which has the advantage that both the axle stump and the hub parts can each be produced or embodied in one operation and in one piece with the hinge halves in the course of the shaping of the hinge halves, each from one blank of sheet-metal material, so that neither additional parts nor special assembly work is required for joining them to the hinge halves.

At the same time, with a view to assembling the hinge, there is the further advantage that the two pre-shaped hinge halves, optionally with the insertion of bearing means of maintenance-free bearing material, need merely be inserted into one another. In particular, the sheet-metal hinges embodied in accordance with the invention can be assembled on relatively simple automatic machines.

According to the invention it is possible, with no loss of simplicity or harm to the production of the hinge halves or the assembly of the hinge, to employ either an embodiment of the leadthroughs oriented in the same direction with respect to the two single-joint regions of the two hinge halves, or an embodiment of the leadthroughs aligned in the same direction from one single-joint region to the other of each of the two hinge halves.

In a first, simple embodiment of a hinge according to the invention, it is provided that the outer diameter of the leadthroughs, forming the male plug part, of one hinge half is at least approximately equivalent to the inner diameter of the leadthroughs, forming the female plug part, of the other hinge half, such that the two parts, the male plug part and the female plug part, engage one another with a play that allows mutual rotation about the hinge axis. Maintenance-free bearing of the hinge is attained in a practical way in that the single-joint regions of the two hinge halves rest on one another via shims made of a maintenance-free bearing material.

In another, preferred embodiment, a further feature of the invention provides that the outer diameter of the leadthroughs, forming the male plug part, of one hinge half is smaller than the inner diameter of the leadthroughs, forming the female plug part, of the other hinge half, and it is additionally proposed in a practical way that the leadthroughs having the larger inner diameter and forming the female plug part of the other hinge half are provided with an offset that demarcates a widened region from a narrowed region, such that bearing bushes embodied as collar bushes, made of a maintenance-free bearing material, are insertable and at the same time supported in the axial direction into the widened region of the leadthroughs that form the female plug part. In this embodiment, the load-bearing forces of the hinge are likewise transmitted by the single-joint regions of the hinge halves, which regions rest on one another with maintenance-free bearing thanks to the collars of the bearing bushes. In addition, the leadthroughs of one hinge half that form the respective male plug parts are supported in the radial direction exclusively via the bearing bushes, embodied as collar bushes, in the female plug parts, so that completely maintenance-free bearing of all the regions movable relative to one another in the two hinge halves is assured.

This embodiment moreover makes it possible that the inner diameter of the narrowed region of the leadthrough having the larger inner diameter and forming the female plug parts leaves a freely accessible passage open for the leadthroughs, forming the male plug part, of the other hinge half. Any metal-to-metal contact between the two hinge halves is thus precluded, so that even over long operation of the hinge, neither abrasion nor corrosion resulting from abrasion can occur.

In order to protect the hinge against becoming unhinged, optionally in the simplest possible way and at no additional expense, the invention also provides that the leadthroughs, forming the male plug part, of one hinge half have a greater axial length than the leadthroughs, forming the female plug part, of the other hinge half and are provided in the region of their free end with means for attaching a securing element.

Specifically, the protection against unhinging can be formed by a snap ring that can be mounted on the male plug part, and for that purpose it may be provided that the means for attaching a securing element are embodied by an encompassing constriction in the region of its free end.

A screw nut or the like may also be considered as a securing means that forms protection against unhinging, and in that case it should be provided that the means for attaching a securing element are embodied by a coiled thread.

An especially simple embodiment of a protection against unhinging, which requires no additional component, can be attained by later deformation of the free end of the male plug part, for which purpose, in accordance with a further characteristic of the invention, it may be provided that the leadthroughs, forming the male plug part, of one hinge half have a greater axial length than the leadthroughs, forming the female plug part, of the other hinge half and are embodied in the region of their free end as a hollow rivet or the like.

It is understood that within the scope of the invention, the provision of a protection against unhinging may be made on only one of the two male plug parts of one hinge half.

In a modified embodiment of the invention, it is provided that only one of the two hinge halves is shaped from a sheet-metal material blank, but the other hinge half is formed by cutting free two single-joint parts from one portion of a continuous hinge profile section; the leadthroughs that form the male plug parts are provided on the single-joint regions of the hinge half formed of sheet-metal material, while the female plug part is formed by hinge eyelet bores in the single-joint parts of the hinge profile portion.

The invention is described in detail in the ensuing description of four exemplary embodiments, shown in the drawing.

DESCRIPTION OF THE PREFERRED EMBODIMENTS

Figure 1:
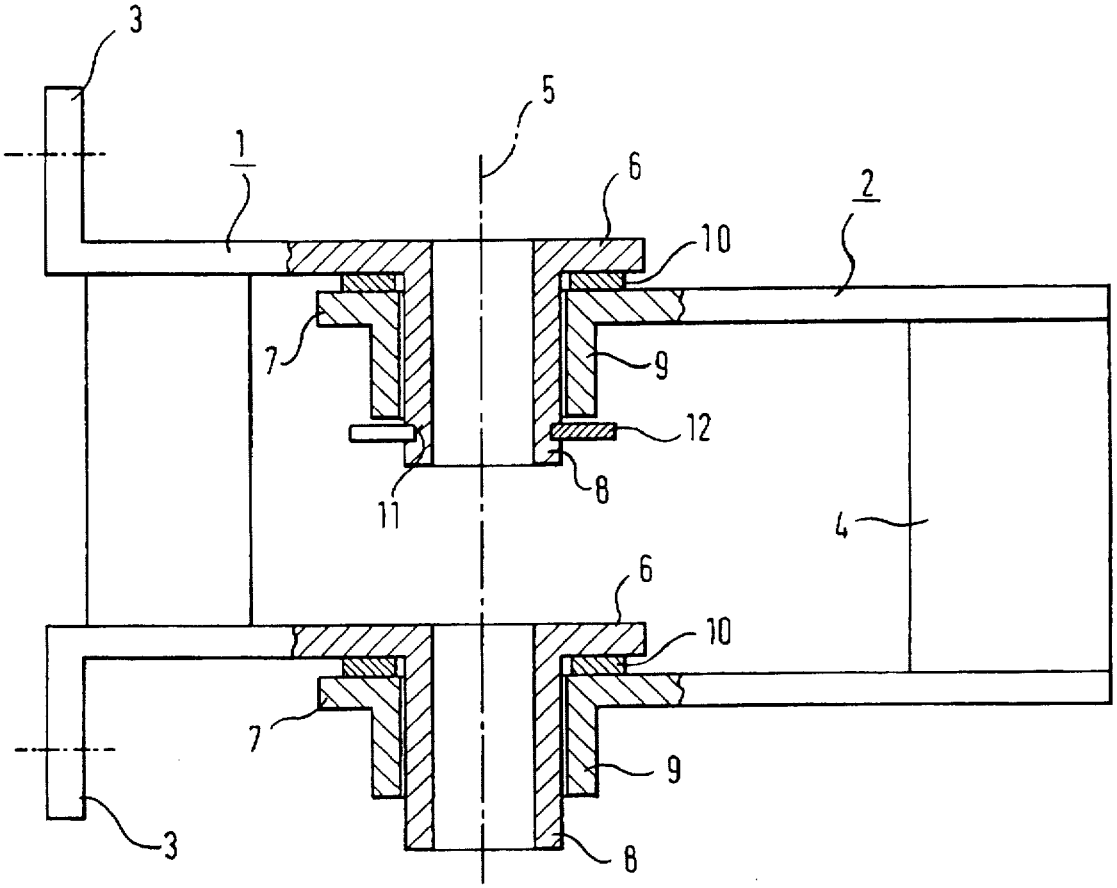
FIG. 1 is a side view, partly an section, of a first embodiment of a motor vehicle door hinge.
Figure 2:
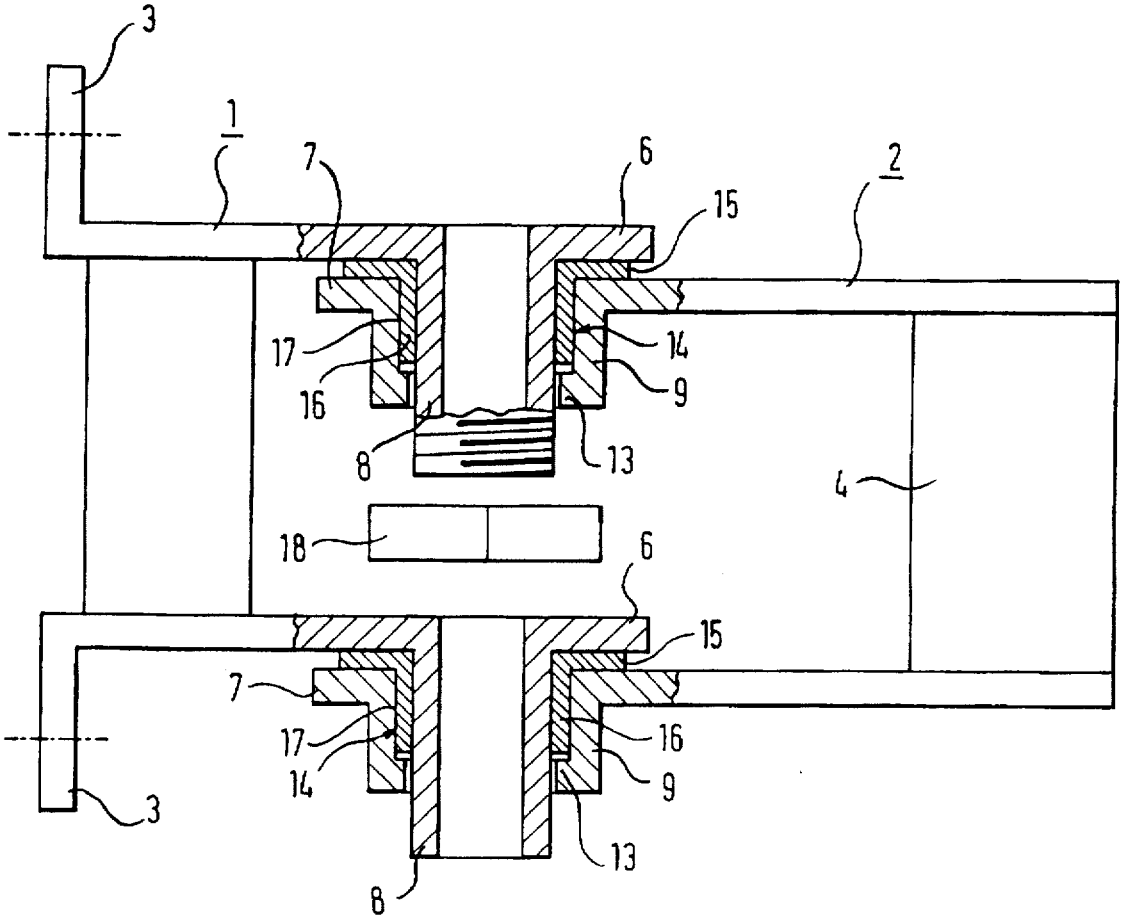
FIG. 2 is a side view, partly in section, of a second embodiment of a motor vehicle door hinge.

The motor vehicle door hinges shown in FIGS. 1 and 2 comprise two hinge halves 1 and 2, each shaped from a sheet-metal material blank, each of which can be secured to either of the two door arrangement parts, that is, the door or the pillar, via a respective hinge tab 3 and 4, and each of which has two single-joint regions 6 and 7, which are parallel to one another and oriented perpendicular to the hinge axis 5. Leadthroughs 8 that form male plug parts and are concentric to the hinge axis 5 are formed in the single-joint regions 6 of one hinge half 1. Leadthroughs 9 that are concentric with the hinge axis 5 and with the leadthroughs 8 of one hinge half 1, but that form female plug parts, are also formed in the other hinge half 2. In the exemplary embodiment shown in FIG. 1, the leadthroughs 8 have an outer diameter that is essentially equivalent to the inner diameter of the leadthroughs 9, such that the two hinge halves, when the leadthroughs 8 and 9 are inserted one into the other, are pivotably joined together about the hinge axis 5. The maintenance-free bearing is embodied in this embodiment by shims 10 of a maintenance-free bearing material that are inserted between the single-joint regions 6 and 7, resting on one another, of the two hinge halves 1 and 2. The leadthroughs 8 that form the male plug part have a larger axial length than the leadthroughs 9 that form the female plug part, and they are provided in their free end protruding beyond the female plug part with an encompassing constriction 11, which is assigned the task of fixing a snap ring 12 that can optionally be provided to protect against unhinging.

In the embodiment shown in FIG. 2, with leadthroughs 8 and 9 forming the male and female plug parts and embodied and disposed essentially identically, it is provided that the leadthrough 9 forming the female plug part is reduced in diameter in the region of its free end by a setback 13. The maintenance-free bearing is embodied in this embodiment by collar bushes 14 of a maintenance-free bearing material; the collar bushes 14, by way of their collars 15, are in engagement between the single-joint regions 6 and 7, resting on one another, of the two hinge halves 1 and 2, while with their bush part 16 they are received in the upper lengthwise portions 17, having a larger inner diameter, of the leadthroughs 9 that form the female plug part. The leadthroughs 8 that form the male plug part here have a diameter that is also less than the inner diameter of the narrowed region of the leadthroughs 9 forming the female plug part, such that the leadthroughs 8 are supported in the radial direction solely via the collar bushes 14 and also cannot come into contact with the leadthroughs 9 in that region. On their free end regions that protrude beyond the leadthroughs 9 forming the female plug part, the leadthroughs 8 that form the male plug part are provided with a coiled thread, on which a nut 18 forming a means of protecting against unhinging can optionally be screwed.

Figure 3:
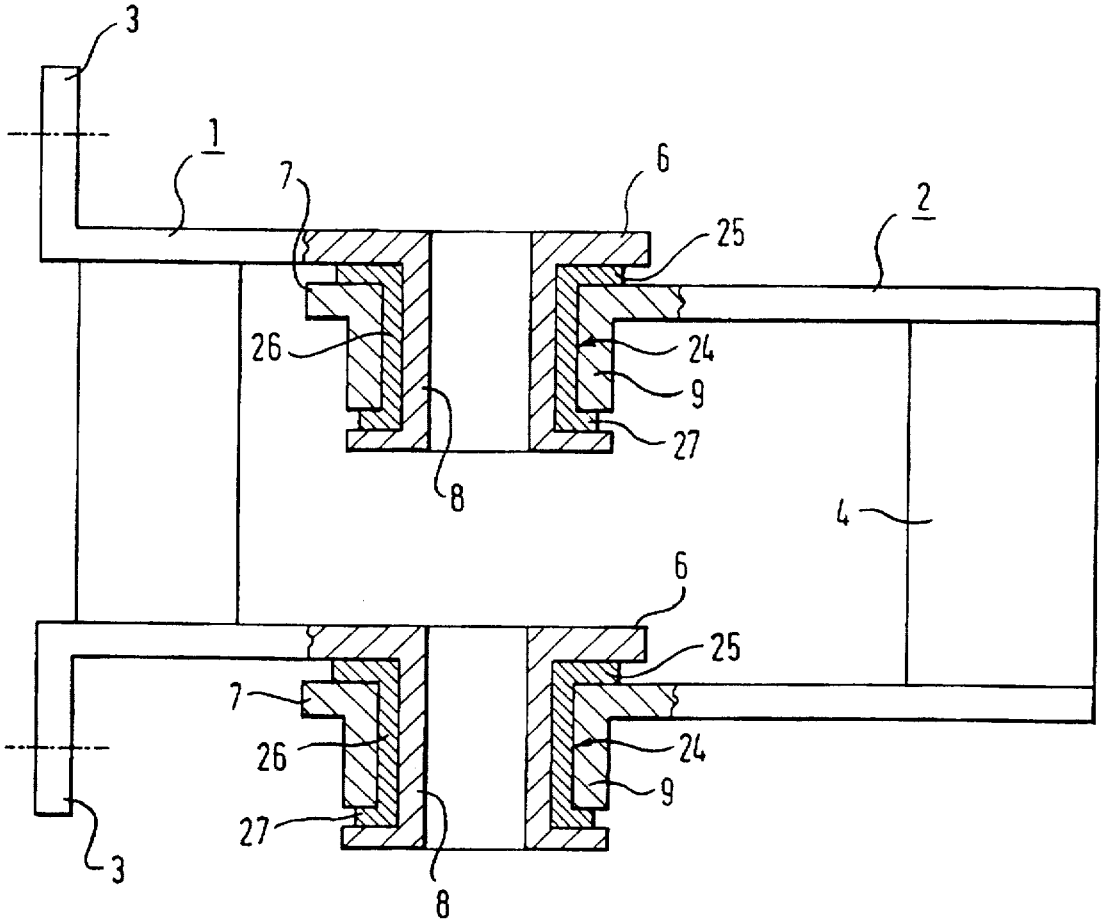
FIG. 3 is a side view, partly in section, of a third embodiment of a motor vehicle door hinge.

In the embodiment shown in FIG. 3, with leadthroughs 8 and 9 again of essentially the same embodiment and disposition forming the male and female plug parts, it is provided that the maintenance-free bearing is embodied by collar bushes 24 of a maintenance-free bearing material; on the one hand, via their collars 25, the collar bushes 24 are in engagement between the single-joint regions 6 and 7, resting on one another, of the two hinge halves 1 and 2, but with their bush part 26 they line the leadthroughs 9, forming the female plug part, over its length and fit with lower collars 27 over the free face end of the leadthroughs 9 that form the female plug part; the lower collars may either be slipped on or embodied by crimping over the bush part 26 in an outward direction.

Figure 4:
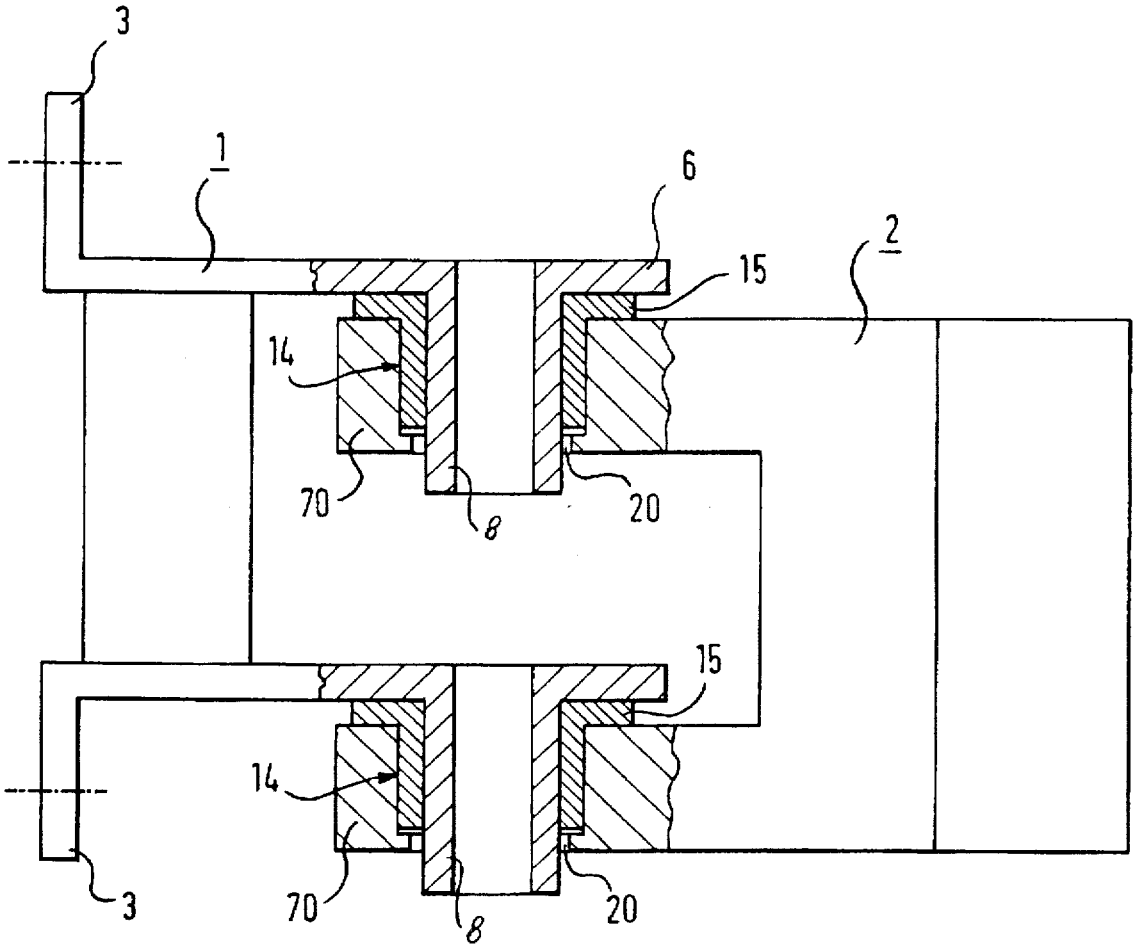
FIG. 4 is a side view, partly an section, of a fourth embodiment of a motor vehicle door hinge.

In the exemplary embodiment shown in FIG. 4, one hinge half 1 is shaped from a sheet-metal material blank, while the other hinge half 2 is formed from a lengthwise portion, provided with single-joint parts 70 that are cut free, of a continuous hinge profile section. The female plug parts, associated with the male plug parts formed by leadthroughs 8 of the one hinge half 1, here are formed by recessed bores 20 in the single-joint parts 70. Collar bushes 14 are inserted for maintenance-free bearing into the bores 20; their collar part 15 is in engagement between the facing surfaces of the single-joint region 6 and the single-joint part 70 and with their bush part they radially support the leadthroughs 8 that form the male plug part.

I claim:

1. A pinless sheet-metal hinge with maintenance-free bearing in combination with motor vehicle doors comprising:

a door arrangement comprising a motor vehicle door and a motor vehicle body;

two hinge halves, each hinge half having a single joint region and each hinge half being securable via hinge tabs to one of the two parts of the door arrangement and meshing with one another with their respective single-joint regions, and at least one of the hinge halves being shaped from a sheet-metal material blank and the single-joint regions being parallel to one another and oriented perpendicular to a hinge axis, and where the two hinge halves are supported pivotally on one another about the hinge axis;

leadthroughs on the single-joint regions of each of the two hinge halves concentric to one another and to the hinge axis and further, the leadthroughs from one hinge half to the other having different diameters, such that the leadthroughs of the two hinge halves can be inserted one into the other in the manner of a male and female plug part; and bearing bushes made of a maintenance-free bearing material are interposed between the leadthroughs of the two hinge halves.

2. The motor vehicle door hinge of claim 1 wherein the leadthroughs each have an inner diameter and an outer diameter and, the outer diameter of the leadthroughs that form the male plug part of one hinge half are at least approximately equivalent to the inner diameter of the leadthroughs that form the female plug part of the other hinge half.

3. The motor vehicle door hinge of claim 2, wherein the outer of the leadthroughs, that form the male plug part, of one hinge half is smaller, by an amount that assures freedom from contact, than the inner diameter of the leadthroughs, that form the female plug part, of the other hinge half.

4. The motor vehicle door hinge of claim 2 wherein the leadthroughs having the larger inner diameter and forming the female plug part further comprises an offset that demarcates a widened region from a narrowed region.

5. The motor vehicle door hinge of claim 4 wherein the bearing bushes comprise collar bushes inserted into the widened region of the leadthroughs that form the female plug part.

6. The motor vehicle door hinge of claim 4 wherein the inner diameter of the narrowed region of the leadthroughs forming the female plug part leaves a freely accessible passage open for the leadthroughs, forming the male plug part, of the hinge half.

7. The pinless sheet-metal hinge of claim 2 further comprising a setback on the inner diameter of the leadthrough that forms the female plug part.

8. The motor vehicle door hinge of claim 1 wherein the leadthroughs, forming the male plug part have a greater axial length than the leadthroughs, forming the female plug part and at least a portion of the greater axial length is provided with a securing portion.

9. The motor vehicle door hinge of claim 8 wherein the securing portion further comprises an encompassing constriction.

10. The pinless sheet-metal hinge of claim 9 wherein the encompassing construction comprises a snap ring.

11. The motor vehicle door hinge of claim 8 wherein the securing portion is threaded portion.

12. The motor vehicle door hinge of claim 8 wherein the securing portion comprises an enlarged outer diameter on the leadthroughs forming the male plug part.

13. The motor vehicle door hinge of claim 1 wherein the bearing bushes comprise shims and the two hinge halves rest on one another by way of the shims.

14. The motor vehicle door hinge of claim 1 wherein the leadthroughs, with respect to the two single-joint regions of the two hinge halves, are oriented in the same direction.

15. The motor vehicle door hinge of claim 1 wherein the leadthroughs, with respect to the two single-joint regions of the two hinge halves, are oriented in the opposite direction.

16. The motor vehicle door hinge of claim 1 wherein the hinge half that includes the female plug parts comprises a portion of one continuous hinge profile section provided with cut-free single-joint parts and hinge eyelet bores.

* * * * *